United States Patent [19]

Williams

[11] Patent Number: 4,888,747

[45] Date of Patent: Dec. 19, 1989

[54] SONAR TRANSDUCER CONTROL ARM ASSEMBLY FOR FISHERMEN

[76] Inventor: C. W. Williams, Rte. 2, Box 163, Lewisville, Ark. 71845

[21] Appl. No.: 297,656

[22] Filed: Jan. 17, 1989

[51] Int. Cl.[4] ..... H04R 15/00

[52] U.S. Cl. ..... 367/173; 367/106

[58] Field of Search ..... 114/249, 250; 367/13, 367/106, 130, 141, 173, 176, 188, 910, 2, 3, 4, 116, 107; 181/110, 122

[56] References Cited

U.S. PATENT DOCUMENTS

| | | | |
|---|---|---|---|
| 2,780,196 | 2/1957 | Janeckie | 367/173 |
| 3,663,933 | 5/1972 | Madison | 367/141 |
| 3,781,780 | 12/1973 | Dow | 367/173 |
| 4,152,690 | 5/1979 | Veatch | 367/173 |
| 4,282,590 | 8/1981 | Wingate | 367/173 X |
| 4,594,582 | 6/1986 | Thompson | 367/141 |

*Primary Examiner*—Brian S. Steinberger
*Attorney, Agent, or Firm*—Stephen D. Carver

[57] ABSTRACT

A remotely actuable boom assembly for floating and positioning a sonar transducer in otherwise inaccessible positions for fishermen. A rigid, supportive frame assembly adapted to be coupled in a desired position upon the side of a conventional fishing boat pivotally mounts an articulated, elongated boom assembly comprised of a pair of control arms which extend generally horizontally outwardly from the side of the boat. The arms are normally spring biased into a preferred operational orientation. The outermost control arm terminates in a housing which is floated upon the water. The suspension system dynamically compensates for wave action or movement during use of the apparatus. The floating housing mounts and controls an internally disposed sonar transducer which may be remotely pivoted by a cable to sweep or scan various regions under the water. A pair of levers associated with the frame enable remote control of the boom and the captivated sonar sensor. The entire boom and sensor may be lifted out of the water by the lever system, and then locked in a desired transportable position for fast movement between fishing spots.

1 Claim, 3 Drawing Sheets

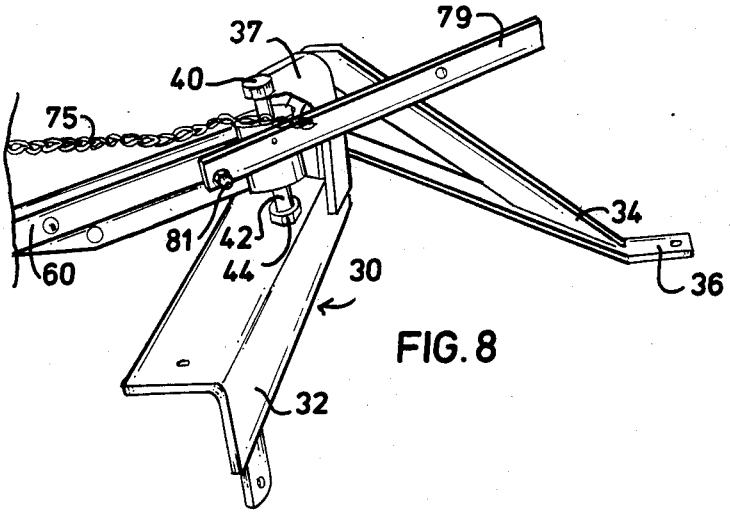
FIG. 8
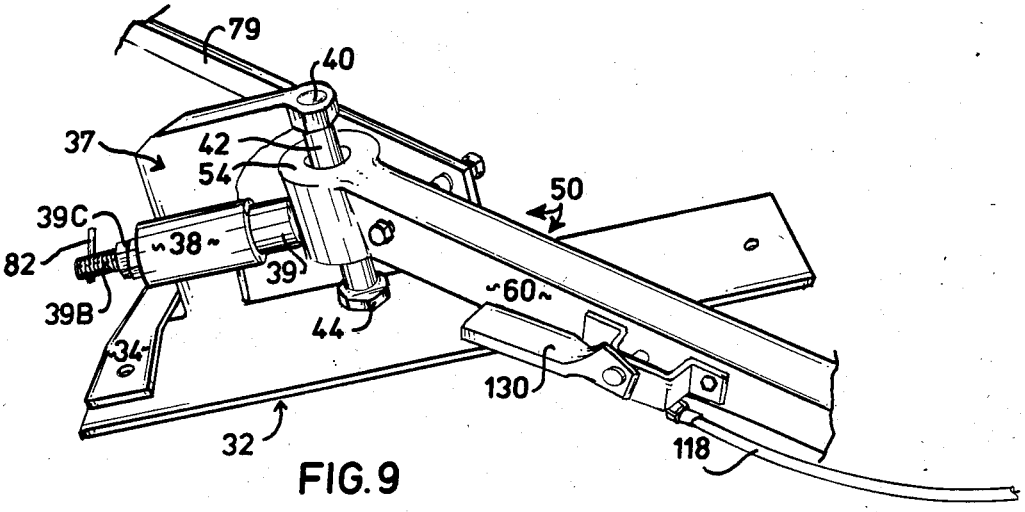
FIG. 9
FIG. 10
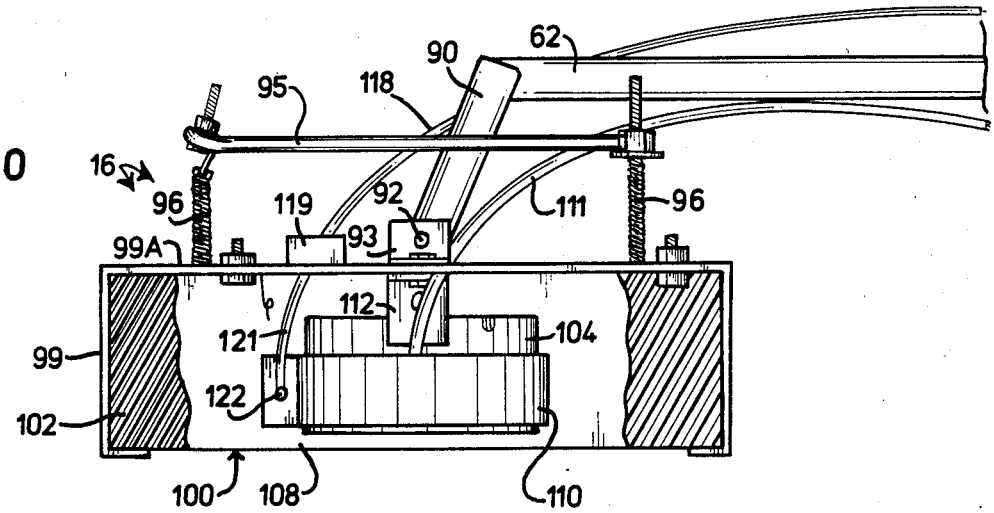

SONAR TRANSDUCER CONTROL ARM ASSEMBLY FOR FISHERMEN

BACKGROUND OF THE INVENTION

The present invention relates generally to apparatus for mounting and controlling transducers employed with sonar sensing devices. More particularly, the present invention is directed to a system, ideally for use by fishermen, which extends a sonar depth finder transducer away from the boat and enables it to probe underwater areas other than those immediately beneath or proximate the boat.

Sonar techniques for scanning underwater obstacles and for measuring depth have long been in use. Various forms of sonar operated transducers are readily available for sport fishermen, and they function as depth finders and fish locators. The sonar unit is electrically powered, and it is interconnected with a remote sonar transducer through a conventional cable. Transducers are well known to fishermen, and they usually are either associated mechanically with the hull of the boat, or they are mounted generally vertically and project away from the side of the boat by conventional usually vertical mounting brackets or the like. It is usually the procedure to scan that area immediately below the boat, and most fishing sonar systems for fisherman are limited by this handicap.

A wide variety of prior art patents exist in the sonar arts. U.S. Pat. No. 3,113,287 discloses a typical fisherman's transducer adapted to be mounted directly in the boat hull. A similar through-hull design for reception of a spherical transducer is disclosed in King patent 3,753,219, issued Aug. 14, 1973. The mounting system for a spherical transducer is also shown in U.S. Pat. No. 3,716,827, issued Feb. 13, 1973.

An outboard transducer assembly for sonar seen in U.S. Pat. No. 2,646,950, issued July 28, 1953. Joseph 3,740,706 discloses a system for mounting a marine hydrophone transducer which allows for non-destructive break-a-way when the probe strikes an underwater obstacle. Mayes patent 2,837,727 also discloses a "vertical" probe mounting system, and means are disclosed for rotating the transducer relative to the mounting system to scan an underwater area proximate the boat. The transom transducer mounting bracket of U.S. Pat. No. 3,729,162 disclosed by Salvato also provides a system wherein an unwanted encounter with an underwater obstacle enables the transducer to be swiveled away out of harms way. The disclosures of U.S. Pat. Nos. 3,714,619; 3,521,225; 2,671,206, and 3,454,923 are also of limited relevance to my invention.

The most relevant prior art known to me is seen in U.S. Pat. Nos. 3,989,216 and 4,152,690 issued to Veatch. The '216 patent discloses a vertical side mounted system for operatively interconnecting a sonar transducer proximate a boat for purposes of swiveling and and scanning beneath and around the boat. Patent 4,152,690 discloses a system wherein the sonar transducer may be operatively associated beneath the water with a trolling motor, and a cable system is provided for pivoting it in a desired scanning direction.

I have found through experimentation and experience that it is usually desirable to remotely position the transducer away from the fishing boat. Also, it is important to provide a pivoting system wherein the transducer can be moved to scan a remote area, more useful results are obtained with a remote system spacing the transducer away from the boat. I have found it desirable to provide a remote system which spaces the depth finder (i.e. or sonar fish locating) transducer away from the side of the boat toward an area or region which may be inaccessible to the boat. I have also found it desirable to "float" the transducer near the top of the water, and in combination with a compensating boom assembly it may be positioned in a variety of "hard to reach" positions which would otherwise be inaccessible by the sonar equipped fisherman.

SUMMARY OF THE INVENTION

The present invention comprises a mounting system for positioning a fisherman's sonar transducer in a controlled position well away from the boat. More particularly, the present invention comprises an articulated boom system which assists in the floating of a remote transducer in spaced relation relative to the boat, for purposes of placing the transducer in otherwise inaccessible positions.

In the best mode, a rigid base frame is secured over a desired side of a boat in a position selected by the fisherman to securely brace the apparatus. An elongated boom extends from the frame brace and terminates in a floating transducer mount which is adapted to be remotely positioned away from the boat. Preferably the boom comprises first and second control arm members which are cooperatively pivoted together and spring biased in a normally extended horizontal position.

A float assembly comprises a rigid housing in which an internal float surrounds the pivoted transducer. A cable extending from the housing along the boom may be operated by the fisherman to pivot the transducer within its housing. Since the boom is preferably swiveled to the frame brace, and since the flotation housing is also pivoted to the other end of the boom, the resultant construction enables the apparatus to adapt for transient position fluctuations caused by waves, rocking of the boat and the like.

The transducer is maintained within a spaced apart position relative to the boat within a continually floating enclosure. When the boom is pivoted relative to the frame, or when the frame base assembly is moved along the boat frame, a variety of different positions may be assumed by the sonar transducer, especially when pivoting is added. Additional control and flexibility of the apparatus is effectuated by a spring suspension system coupling the terminal end of the boom to the flotation assembly.

In order to manually control the boom an elongated lever assembly interconnected with one of the boom control arms via a suitable chain may be manipulated by the operator. The lever may thus control the boom assembly orientation as desired. When the boom and associated sensor apparatus is lifted out of the water, the boom mounting swivel may be unlocked and the entire apparatus may be moved to a comfortable transportation position within the boat.

Thus a fundamental object of the present invention is to provide a remotely controlled sonar transducer scanning system for fishermen, which may be oriented in a plurality of desired operational positions.

A similar object of the present invention is to provide a boat mounted system of the character described which positions a scanning sonar transducer substantially horizontally distant from the boat.

Another object of the present invention is to provide a pivoting transducer scanning system of the character described which may be remotely positioned into otherwise hard-to-reach positions which cannot be normally scanned or observed by any known fishing systems.

Yet another object of the present invention is to provide a sonar mounting system of the character described which may be employed in conjunction with a wide variety of existing conventional sonar transducers and equipment.

Thus a fundamental object of the present invention is to enable the transducer to be positioned where the boat cannot be positioned.

A similar fundamental object is to provide a transducer mounting system for fishermen which may be easily installed or retracted.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 8 is a fragmentary perspective view thereof;

FIG. 9 is an enlarged scale, fragmentary, perspective view illustrating the control boom swivel and lock system; and, FIG. 10 is an enlarged scale fragmentary, sectional view taken generally along line 10—10 of FIG. 6.

DETAILED DESCRIPTION

Figure 1:
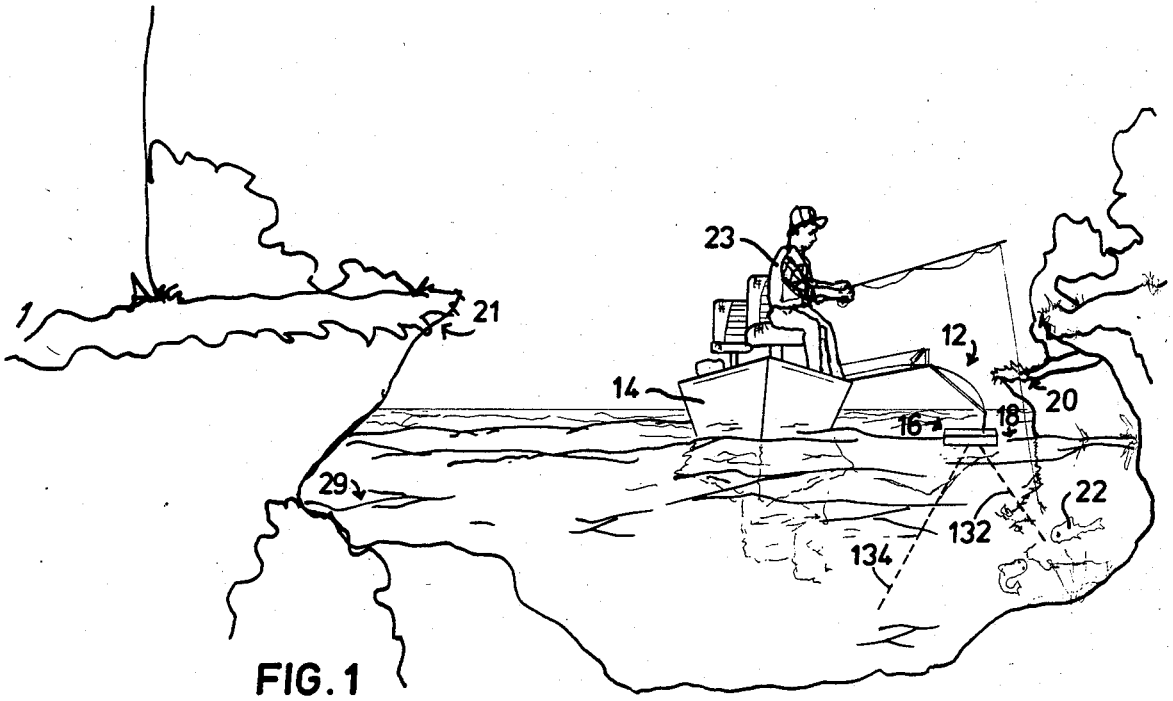
FIG. 1 is a pictorial view illustrating the best mode of my new SONAR TRANSDUCER CONTROL ASSEMBLY FOR FISHERMEN in use upon a conventional fishing boat, adjacent typical underwater structure.
Figure 2:
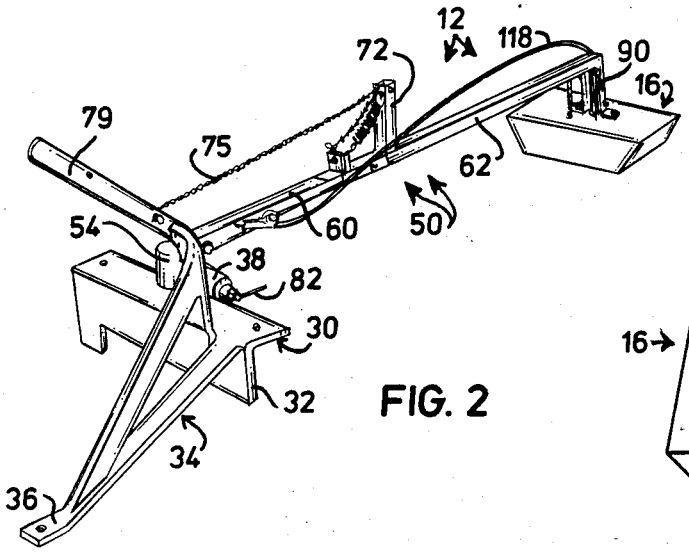
FIG. 2 is an enlarged scale, fragmentary perspective view thereof.
Figure 3:
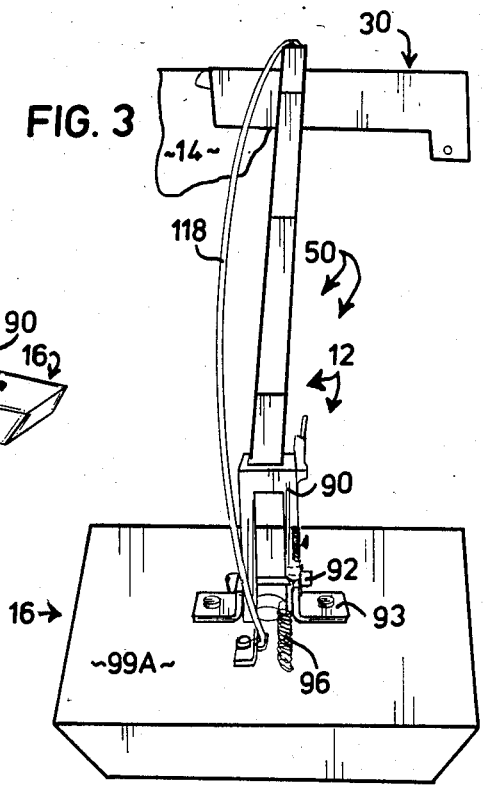
FIG. 3 is an enlarged scale, fragmentary, top perspective view thereof.
Figure 4:
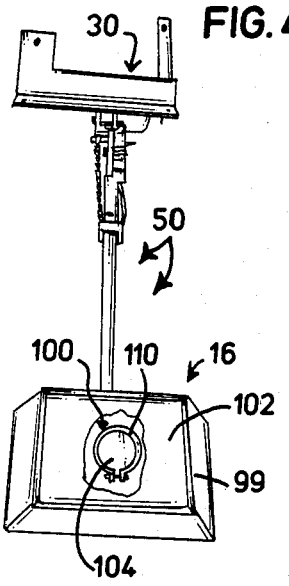
FIG. 4 is a reduced scale fragmentary bottom perspective view thereof, with portions broken away for clarity.
Figure 5:
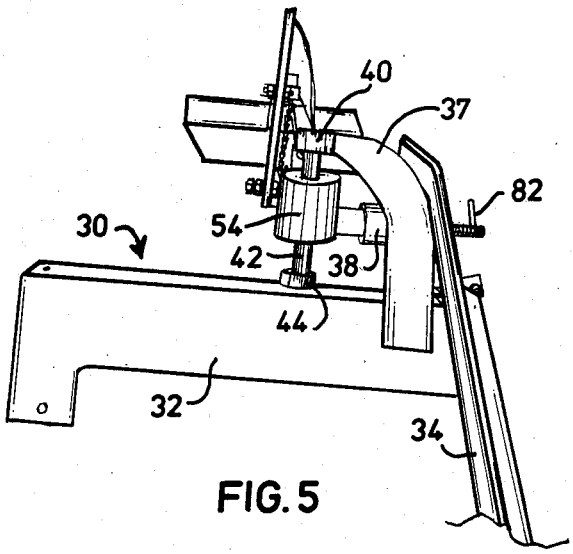
FIG. 5 is an enlarged scale, fragmentary rear perspective view thereof.

With initial reference now directed to FIGS. 1 through 3 of the appended drawings, a sonar transducer mounting and control assembly constructed in accordance with the best mode teachings of the present invention has been generally designated by the reference numeral 12. As obsserved in FIG. 1, system 12 is adapted to be coupled to a conventional boat 14 so that it may project horizontally outwardly away from the boat. A float system, generally designated by the reference numeral 16 mounts a transducer, as will hereinafter be explained in detail, which is interconnected with the conventional sonar electronics usually disposed within boat 14.

As best illustrated in FIG. 1, the flotation system 16 is adapted to be operationally disposed within a region, generally designated by the reference numeral 18, which would otherwise be difficult, if not impossible, for the fisherman 23 to scan through sonar. Since his boat 14 can not reach area 18 without a collision with cliff 20, he might otherwise fail to appreciate or determine the presence of fish 22. It will also be appreciated that potential obstructions such as the illustrated overhanging cliff 21 normally prevents the fisherman 23 from using his sonar in underwater region 29. However, with the system to be hereinafter described he need merely reposition the apparatus 12 or boat 14 so as to "attack" region 29 and scan it for the presence of fish.

With primary reference now directed to FIGS. 2–5, 8 and 9, the preferred base frame assembly has been generally designated by the reference numeral 30. Assembly 30 comprises an elongated, rigid L-bracket 32 which is adapted to be secured at a desired position upon the side of the boat. Bracket 32 is welded to a convergent strut 34 which terminates interiorly of the boat in a foot 36 adapted to be fastened to the floor of the boat so as to brace the apparatus. As best viewed in FIG. 9 an arcuate strut portion 37 of the frame assembly rises upwardly from and is welded to bracket 32. It mounts a transverse housing 38 which will hereinafter be explained, and it terminates in a forward receptive tip 40 which secures an elongated axle 42 in association with a lower bearing 44 welded to the surface of bracket 32.

Figure 7:
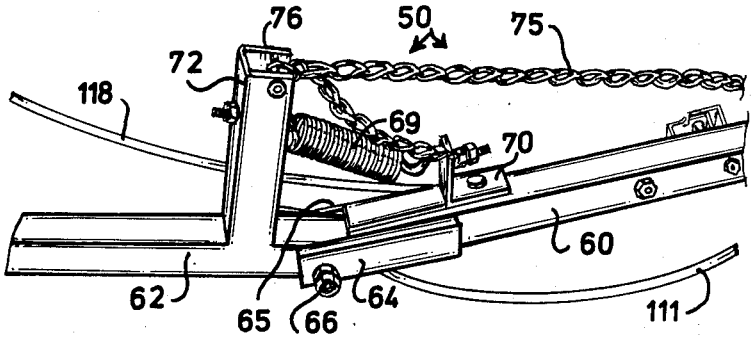
FIG. 7 is a fragmentary, side perspective view thereof.

The boom assembly 50 includes a first lever arm member 60 terminating in a sleeve-like bearing 54 which coaxially engages axle 42 to enable pivotal displacement of the control boom assembly. The control boom assembly 50 comprises a first control arm 60 which is pivotally articulated with a second, outermost control arm 62. As best viewed in FIG. 7, the terminal end of arm 60 terminates in a pair of spaced apart brackets 64 and 65 which are coupled on opposite sides of control arm member 62 and secured by a conventional fastener 66. Control arm members 60 and 62 are normally spring biased to assume a substantially horizontal position. When the boom 50 is disposed over the water (FIG. 1) control arm 62 deflects downwardly from the position of FIG. 7 and assumes the arc position illustrated in FIG. 1. When so disposed as in FIG. 1, spring 69 normally biases these arm members 60 and 62 towards a substantially horizontal position.

Control arm spring 69 extends between a suitable bracket 70 fastened to the end of control arm member 60, and an offset, vertically elevated member 72 welded to the inner end of boom member control arm 62. An elongated chain 75 extends between the top 76 of offset 72 and a lever 79 (FIGS. 2, 8) which is pivotally connected at 81 to the inner region of control arm 60. It will thus be observed that as lever 79 is manually pivoted by fisherman 23 the boom apparatus 50 will be lifted out of the water. Additional control positioning is effectuated by a lock system threadably associated with sleeve 38 (FIG. 9) which includes friction end 39 projecting towards the bearing end 54 of control arm member 60. When handle 82 is twisted, because threaded shaft 39B is coupled to nuts 39c, terminal end 39 will be moved into or out of frictional engagement with boom-bearing sleeve 54 to lock or unlock the control arm boom.

Figure 6:
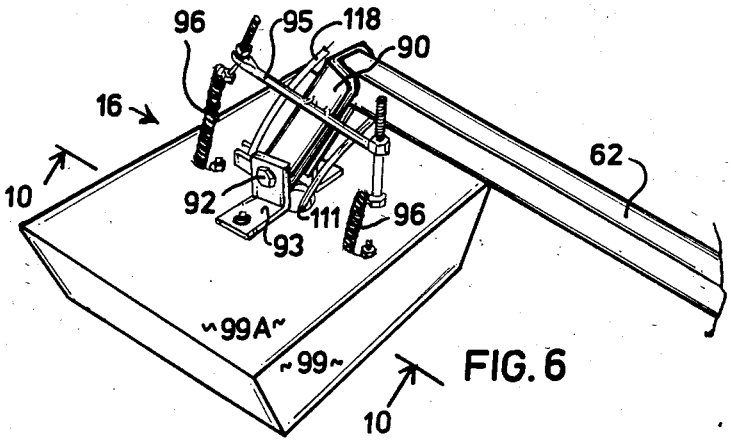
FIG. 6 is a fragmentary front perspective view thereof.

With reference now primarily directed to FIGS. 6 and 10, the outermost end of control arm member 62 terminates in a downwardly angled member 90 which is welded thereto. Member 90 is pivotally coupled to the transducer float assembly 16 by a suitable fastener 92 which extends between a pair of similar end brackets 93 affixed on opposite sides of member 90. Additionally, control arm 62 is linked to the boat system 16 through a spring suspension system, comprising a transverse rod 95 welded to member 90 and connected at its ends with springs 96 which extend into contact with the float housing 99. Thus, in use, when float member 16 moves in response to waves or it experiences other transients, the action of springs 96 in the suspension system will tend to maintain the orientation of member 90 relatively angularly constant with respect to the housing.

With primary reference directed to FIGS. 3, 4, 6 and 10, the flotation system 16 comprises a generally cubical, rigid housing 99 having a top surface 99A (to which brackets 93 and springs 96 are connected) and a lower, open interior generally designated by the reference numeral 100. The interior 100 is surrounded by a peripheral float 102 preferably formed of styrofoam which surrounds a transducer 104 which is positioned within a center area 108 of the float. Transducer 104 is captivated by an encircling band 110 and pivotally coupled to the underside of the housing surface 99A with an appropriate bracket 112. An elongated coaxial cable 111 extends between the transducer and the interior of the boat for electrical interconnection with conventional sonar electronic apparatus (not shown). The sonar transducer 104 is thus free to pivot beneath and within the housing 99. Pivot control is effectuated by an elongated cable 118 which is anchored to surface 99A by bracket 119, and its internal wire element 121 is captured by fastener 122 at the edge portion of transducer bracket 110. Control cable 118 extends towards the boat along the boom assembly 50 and, as best seen in FIG. 9, it is similarly associated with lever 130 secured to control arm 60 which facilitates transducer pivoting.

Thus as the fisherman 23 operates boat 14, as illustrated in FIG. 1, he may pivot the transducer towards the direction of dashed line 132 or he may pivot it rearwardly towards the position of dashed line 134. Similarly, by loosening the locking assembly previously described, the entire boom and flotation apparatus may be moved either towards the bow or the stern of boat 14 to fully explore the otherwise out of reach area 18 (FIG. 1).

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A boat-mounted transducer flotation assembly for enabling a fisherman to remotely position a depth-finder transducer in a hard-to-reach area upon the surface of the water apart from his boat, said assembly comprising:

a rigid frame for operatively mounting said assembly, said frame comprising a rigid L-bracket adapted to be secured to the side of said boat, a supportive strut which extends rearwardly from said L-bracket and is adapted to be secured to the floor of said boat, an arcuate strut portion extending upwardly from said L-bracket and terminating in a forward receptive tip, and an axle captivated by said tip;

an elongated control boom pivotally coupled to said frame and extending generally horizontally outwardly therefrom, said control boom comprising:

a first rigid, elongated control arm member comprising rigid sleeve-like bearing means penetrated by said axle for enabling said control boom to pivot horizontally relative to said frame;

a second rigid control arm member connected to said first control arm member and vertically pivotal with respect thereto, said second member comprising a rigid vertical offset projecting upwardly therefrom; and, spring means for normally yieldably biasing said first and second control arm members into a fully horizontally extended position, said spring means coupled at one end to said first control arm member and at its opposite end to said offset, whereby as said second control arm member pivots downwardly relative to said first control arm member, gradually increasing spring tension is applied;

lock means for selectively frictionally engaging said bearing means to at least temporarily lock said boom in a desired position relative to said frame and thus said boat, said lock means comprising a cylindrical sleeve having a terminal end for frictionally engaging said bearing of said first control arm member driven by a threaded shaft associated with a manually actuable handle;

a transducer mount remotely secured to said control boom, said mount comprising:

a rigid enclosure having a top surface and a lower, open interior;

a float confined within said lower open interior of said enclosure, said float having a hollowed center;

means extending between said second control arm member and said enclosure for flexibly securing the enclosure at the end of said control boom; and, mounting bracket means for yieldably suspending said transducer within said enclosure at said float center;

lever means mechanically coupled to said transducer via cable means for facilitating pivotal movements of said transducer relative to said enclosure from a position within the boat;

control chain means for manually lifting said control boom out of the water, said chain means extending between a chain control lever associated with said frame and said vertical offset;

spring suspension means for yieldably maintaining said enclosure in a predetermined, generally stable position relative to said second control arm; and, electrical cable means for electrically coupling said transducer to a depth finding apparatus positioned within said boat.

* * * * *